US005568665A

United States Patent [19]

Fick

[11] Patent Number: 5,568,665

[45] Date of Patent: Oct. 29, 1996

[54] PAINT CAN RIM PUNCHING TOOL AND BOTTLE OPENER

[76] Inventor: Joseph C. Fick, 25399 The Old Rd., Unit 2204, Newhall, Calif. 91321

[21] Appl. No.: 422,809

[22] Filed: Apr. 17, 1995

[51] Int. Cl.[6] ..... B44C 7/00

[52] U.S. Cl. ..... 7/105; 7/151; 81/3.09; 30/366

[58] Field of Search ..... 7/105, 151; 81/3.09, 81/3.55; 30/366

[56] References Cited

U.S. PATENT DOCUMENTS 2,118,159 5/1938 Castner ..... 81/3.55

2,624,489 1/1953 Wishart ..... 7/151 X 4,598,435 7/1986 Borodulin et al. ..... 81/3.09 X

*Primary Examiner*—James G. Smith

*Attorney, Agent, or Firm*—Jack C. Munro

[57] ABSTRACT

A tool designed primarily to be used in conjunction with paint cans to not only open the lid of a paint can but also to puncture the rim groove of the paint can forming openings that permit any paint that accumulates in the rim groove to flow back within the paint can. The tool is formed into an elongated housing that has a back end adapted to be struck by a hammer and a front end formed into a plurality of sharply pointed ends. The sharply pointed ends are deflected slightly from the remaining portion of the front end which facilitates usage of the tool to open the lid of the paint can. The front end also is to include a conventional bottle opener.

2 Claims, 1 Drawing Sheet

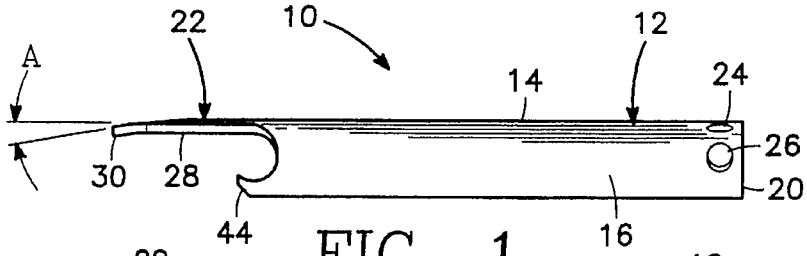
FIG. 1
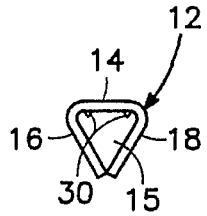
FIG. 2
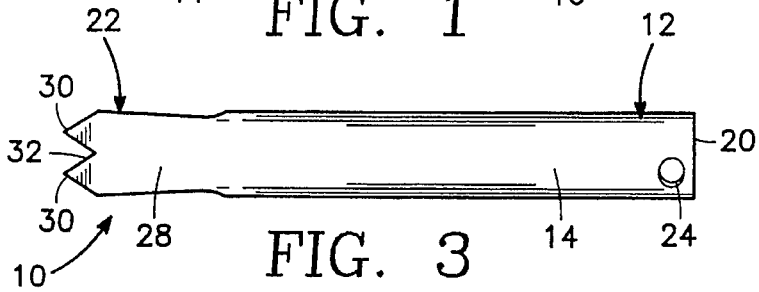
FIG. 3
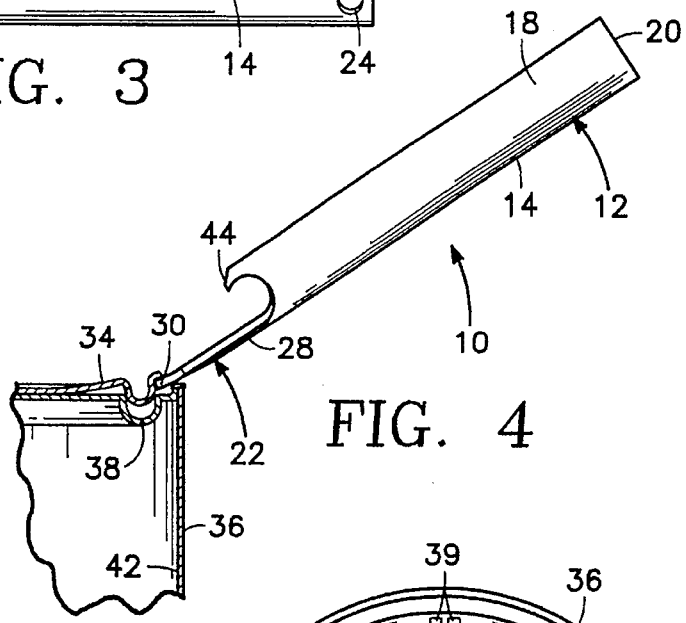
FIG. 4
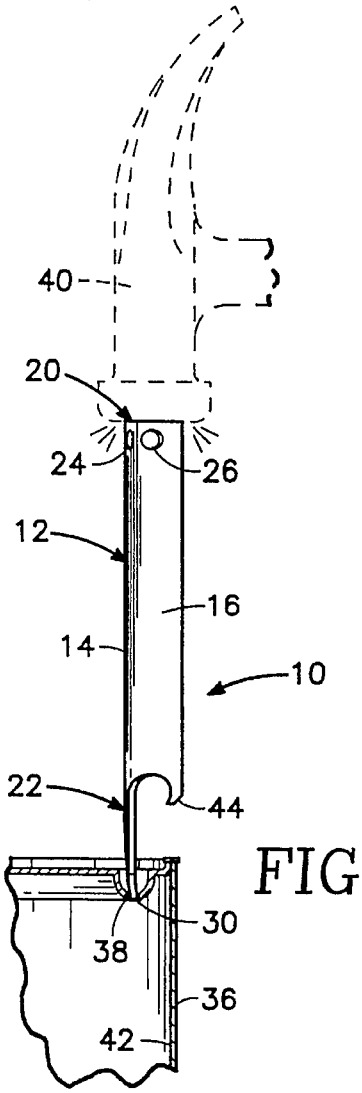
FIG. 5
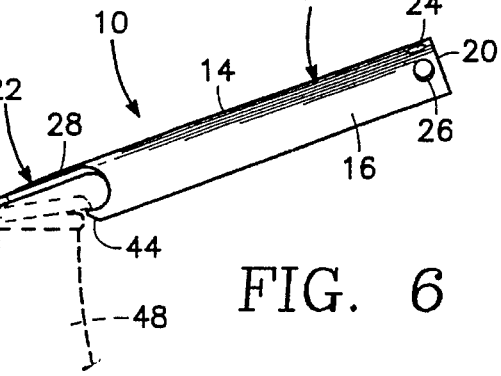
FIG. 7
FIG. 6

PAINT CAN RIM PUNCHING TOOL AND BOTTLE OPENER

BACKGROUND OF THE INVENTION

1. Field of the Invention

The field of this invention relates to tools and more particularly to a tool that is designed primarily to be used in conjunction with a paint can.

2. Description of the Prior Art

In the past there have been numerous tools that have been designed to use in conjunction with paint cans. It has been common to manufacture different types of pry tools which are to be usable to pry to a disengaged position the lid of the paint can. It also has been known in the past to incorporate some type of sharpened end on a tool with this sharpened end being utilized to puncture the rim groove of the paint can so that, upon any paint accumulating in the rim groove, the paint will automatically flow back into the interior of the paint can. However, none of the prior art tools discloses a combination tool which is structured so that it can simply and beneficially perform the functions of prying a lid off a paint can and perforating the paint can rim groove.

SUMMARY OF THE PRIMARY INVENTION

The primary objective of the present invention is to provide a new and improved tool which is adapted to remove lids from paint cans and also perforate the rim groove of a paint can.

Another objective of the present invention is that by perforating the rim groove it is then unnecessary to constantly remove accumulated paint within the rim groove as the paint can is being used in the painting operation.

Another objective of the present invention is to provide a new and improved tool which is configured to comfortably fit in the hand of a user.

Another objective of the present invention is to construct a tool which can be manufactured at a relatively inexpensive cost and thereby sold to the ultimate consumer at an inexpensive price.

BRIEF DESCRIPTION OF THE DRAWING

FIG. 1 is a side elevational view of the tool of the present invention;

FIG. 2 is a back end view of the tool shown in FIG. 1;

FIG. 3 is a top plan view of the tool shown in FIG. 1;

FIG. 4 is a side elevational view depicting usage of the tool in order to disengage the lid of a paint can;

FIG. 5 is a side elevational view showing usage of the tool in order to perforate the rim groove of a paint can;

FIG. 6 is a side elevational view showing usage of the tool as a conventional bottle opener;

FIG. 7 is an isometric view of a portion of the paint can rim showing holes formed therein.

DETAILED DESCRIPTION OF THE PREFERRED EMBODIMENT

Referring particularly to the drawing, there is shown the tool 10 of this invention. The tool 10 is formed of an elongated housing 12 which is formed in transverse cross-section to be triangular in shape. This triangular in shape elongated housing 12 has a planar top surface 14 and planar side surfaces 16 and 18. Top surface 14 and side surfaces 16 and 18 enclose an internal chamber 15. Elongated housing 12 has a back end 20 and a front end 22 which is located furthest from the back end 20. The back end 20 includes a pair of holes 24 and 26 which are for the purpose of permitting engagement of a chain or other similar type of attaching device so that the tool 10 may be suspended from a tool box, key chain, belt loop or other similar types of exterior structures.

The front end 22 is formed into a forwardly extending section 28 which then terminates in a pair of sharply pointed ends 30. The sharply pointed ends 30 are of the same size and define a V-shaped groove 32 therebetween. The sharply pointed ends are deflected or inclined in an inward direction which is basically in a direction toward the housing 12. This deflection is represented as angle A in FIG. 1 of the drawings. The amount of deflection of angle A will be approximately fifteen to twenty degrees.

Referring particularly to FIG. 4, the tool is to be grasped by the hand of the user with the hand being located around the housing 12. The sharply pointed ends 30 are to be located so that the pointed ends 30 are deflected upward against the undersurface of the lid 34 of a paint can 36. This deflection of the sharp pointed ends 30 facilitates the disengagement of the lid 34 from the paint can 36.

When the lid 34 is completely disengaged from the lid 36, there is exposed a rim groove 38. The tool 10 is to then be grasped by the user and held in an upright position so that the sharp pointed ends 30 are located within the rim groove 38. Upon striking of the back end 20 by a sharp blow, such as with a conventional hammer 40, the sharp pointed ends 30 will penetrate the rim groove 38 and form a pair of holes 39. This procedure is to be repeated several times forming several holes 39 within the rim groove 38. Therefore, during removal of the paint within the paint can 36 by conventional painting operations with a brush which will inherently cause paint to be accumulated within the rim groove, that paint will then tend to automatically flow back into the interior 42 of the paint can 36.

To further make the tool 10 to be more functional, included within the front end 22 is a conventional bottle opener 44. The bottle opener 44 cam be used in a conventional manner to remove a bottle cap 46 from a bottle 48.

It is to be understood that the tool 10 of this invention is to be constructed of a rigid material with generally metal being preferred. Preferable metals would be steel or a steel alloy.

What is claimed is:

1. In combination with a paint can having an annular rim groove, said paint can having a lid, said lid having an annular rim located at the periphery of said lid, said annular rim to be located within said annular groove, a tool usable in conjunction with said annular rim groove and said annular rim, said tool comprising:

an elongated rigid housing having a front end and a back end, said front end being formed into a lineal extending section which includes a plurality of sharply pointed ends, said sharply pointed ends having an inclination relative to said extending section, said sharply pointed ends are to be located underneath said annular rim of said lid with said sharply pointed ends being directed against said annular rim due to said inclination of said sharply pointed ends and upon application of manual force of sufficient size against said housing in a downward direction said annular rim of said lid will be moved to be disengaged from said annular rim groove, said tool can be repositioned so said sharply pointed ends are located in said annular rim groove and upon application of a sharp blow to said back end said sharply pointed ends will penetrate said annular rim groove forming openings permitting flow of paint from said annular rim groove into said paint can, said inclination being constant and within the range of fifteen to twenty degrees which facilitates usage of said sharply pointed ends to remove said lid from said paint can.

2. The combination as defined in claim 1 wherein:

said front end including a bottle opener, said bottle opener including said sharply pointed ends.

* * * * *